US006545573B1

(12) United States Patent
Dautartas et al.

(10) Patent No.: US 6,545,573 B1
(45) Date of Patent: Apr. 8, 2003

(54) RESONANCE ELIMINATION IN HIGH SPEED PACKAGES

(76) Inventors: Mindaugas F. Dautartas, 2006 Sycamore Trail, Blacksburg, VA (US) 24060; John M. Geary, 6780 Walker Rd., Macungie, PA (US) 18062

( * ) Notice: Subject to any disclaimer, the term of this patent is extended or adjusted under 35 U.S.C. 154(b) by 0 days.

(21) Appl. No.: 09/679,325

(22) Filed: Oct. 4, 2000

Related U.S. Application Data

(60) Provisional application No. 60/190,833, filed on Mar. 21, 2000.

(51) Int. Cl.[7] ..... H01P 1/00
(52) U.S. Cl. ..... 333/247; 333/257
(58) Field of Search ..... 333/247, 12, 257, 333/251; 257/728; 385/2; 361/816, 818, 820; 174/35 R

(56) References Cited

U.S. PATENT DOCUMENTS 4,575,701 A * 3/1986 Greed ..... 333/258
4,802,178 A 1/1989 Ury ..... 372/36
5,030,935 A 7/1991 Williams et al. ..... 333/246
5,260,513 A * 11/1993 Giles et al. ..... 174/35 MS
5,773,151 A 6/1998 Begley et al. ..... 428/446
6,121,833 A * 9/2000 Rattay et al. ..... 330/53
6,157,544 A * 12/2000 Ferling et al. ..... 361/800

* cited by examiner

*Primary Examiner*—Robert Pascal
*Assistant Examiner*—Joseph Chang
(74) *Attorney, Agent, or Firm*—Duane Morris LLP

(57) ABSTRACT

An optical microwave package eliminates launching electrical modes into a microwave strip-line by forming a moat in a housing portion of the package to suppress microwave resonant energy. The moat can be filled with a conductive material to further suppress package resonances. Additionally, the bottom of a substrate positioned within the housing is isolated from any conductive metal to further suppress microwave resonant energy.

16 Claims, 4 Drawing Sheets

RESONANCE ELIMINATION IN HIGH SPEED PACKAGES

This application claims priority of U.S. provisional application Ser. No. 60/190,833, filed on Mar. 21, 2000.

FIELD OF THE INVENTION

This invention relates to microelectronics, and specifically to microwave frequency optical packages.

BACKGROUND OF THE INVENTION

Microwave resonance in high-speed packages sometimes degrades the performance of the packages by deleteriously increasing the return loss of electrical signals fed into the package. The conventional approach to reduce the microwave resonance is to introduce thick sheets of resistive polymers, far from the launch site, onto the walls or lid of the packages to absorb microwaves after they are generated. However, with communication frequencies constantly increasing, this approach is insufficient to achieve the decrease in return loss desired, particularly at a time when the microwave spectrum technology is extending from 1 to 40 GHz and above.

SUMMARY OF THE INVENTION

A microwave package includes a housing having a moat formed in the housing to suppress microwave resonant energy. The moat may be filled with microwave absorbent material to further suppress microwave resonant energy.

BRIEF DESCRIPTION OF THE DRAWINGS

The invention is best understood from the following detailed description when read in connection with the accompanying drawing. It is emphasized that, according to common practice in the semiconductor industry, the various features of the drawing are not to scale. On the contrary, the dimensions of the various features are arbitrarily expanded or reduced for clarity. Included in the drawing are the following figures.

DETAILED DESCRIPTION

An exemplary embodiment of the invention includes a package having a moat in the package body filled with a conductive material having a sheet resistance of approximately 20 ohms/square, to reduce the resonance in a 40 GHz optical microwave package and reduce the return loss to −10 dB or better.

Figure 1:
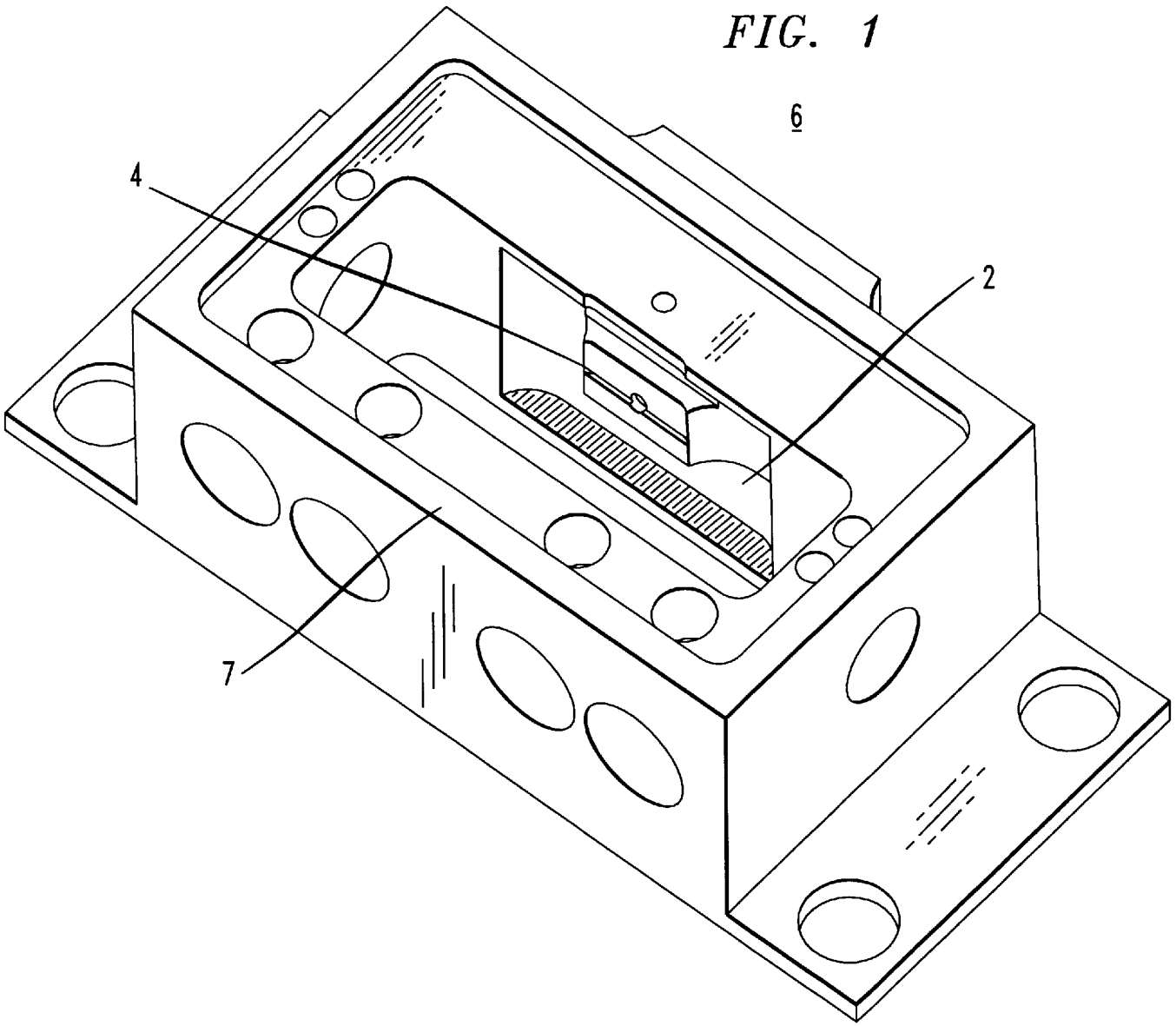
FIG. 1 is an isometric view of a housing in which a microwave component is placed, in accordance with an embodiment of the present invention.

Referring now to the drawings, wherein like reference numerals refer to like elements throughout, FIG. 1 is an isometric view of a housing 6, in which a microwave component, such as an electro-absorptive modulator 16, a high speed receiver, or any appropriate optoelectric device, is placed. Housing 6 comprises a moat 2, and a ledge 4 for securing the microwave component 16. Moat 2 is formed in the walls of housing 6. Although not visible in the perspective view shown in FIG. 1, another moat 2 is also formed in wall 7 of housing 6.

Figure 3:
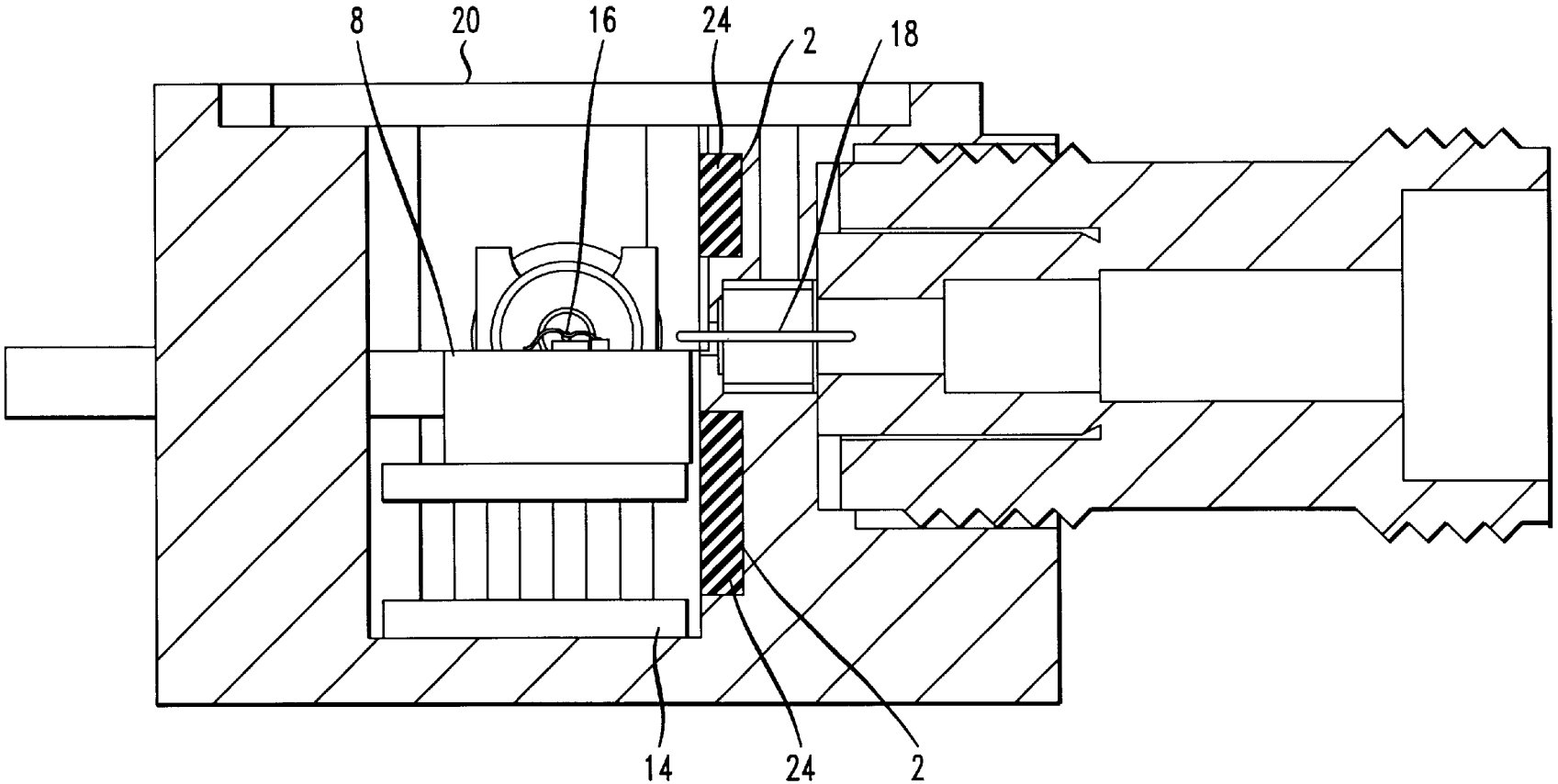
FIG. 3 is a cross sectional view of a microwave device having a moat, in accordance with the present invention.

FIG. 3 is a cross sectional view of a microwave package 22 having a moat 2, in accordance with an embodiment of the present invention. Moat 2 is formed in the housing 6 and may also be filled with a microwave absorber 24. The inventors have discovered that using a resistive semiconductor like silicon in the moat suppresses and absorbs these microwave resonances without appreciably degrading the electrical coupling efficiency.

Germanium, polycrystalline silicon, single-crystal silicon, gallium arsenide, monolithic doped silicon, or a single crystal semiconductor may be used as the microwave absorber 24.

Improved electrical performance is obtained by using a resistive semiconductor material in the moat 2 that is monolithic, as opposed to the polymer pastes and sheets of the prior art, has a good coefficient of thermal expansion to match the dielectric substrate, has a good thermal conductivity, and can be easily modified to accommodate a variety of packaging schemes. It is also envisioned that alternative microwave absorbing materials, such as resistive ceramic susceptors, compressed iron powder and carbon may be used.

The relative positioning of housing 6 and the microwave device 22 shown in FIG. 3 is such that edge 20 is coupled to ledge 4. Optical energy is coupled to the exemplary microwave component 16 by optical fiber 18. In the embodiment of the invention depicted in FIG. 3, the device 16 is mounted on a submount 8, which may be formed of beryllium oxide (BeO), aluminum oxide, or the like. The submount 8 is in turn coupled to thermoelectric cooler (TEC) 14. The inventors have discovered that forming a moat 2 in the housing 6 suppresses microwave resonant energy. It has been calculated that a return loss of less than −10 dB is attainable.

Note that the thermoelectric cooler 14 may not always be required, depending upon the amount of heat that needs to be removed.

Figure 2:
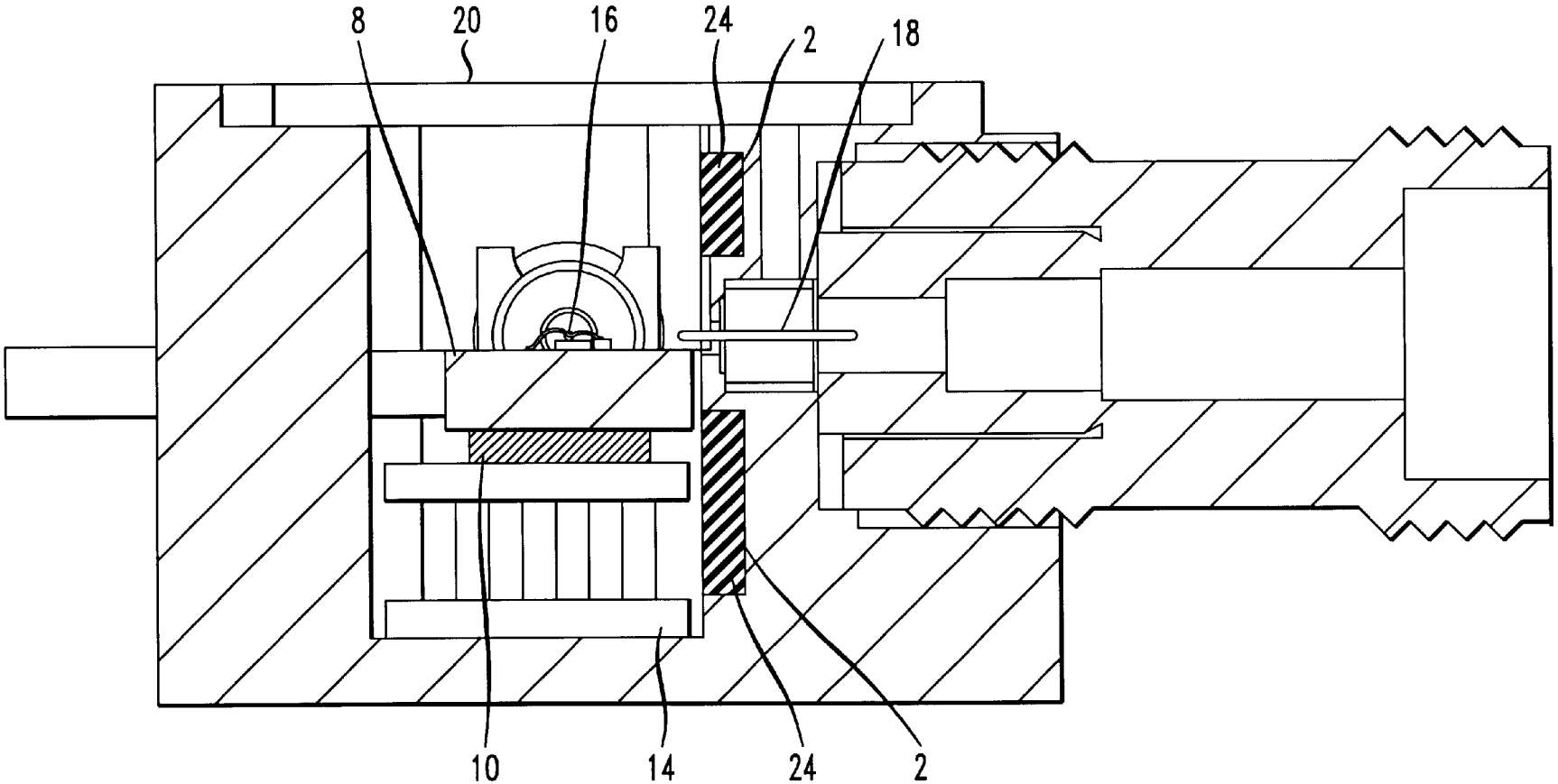
FIG. 2 is a cross sectional view of a microwave device having a moat, with an isolated substrate.

FIG. 2 is a cross sectional view of a variation of the exemplary microwave package 22 having an isolated substrate 8 and a moat 2. In the variation of FIG. 2, a microwave absorber 10 is introduced into the cavity where the microwaves may be generated. The dielectric substrate is sufficiently thick such that electrical fields in the planar waveguide are not appreciably attenuated; yet the resonances are reduced. The optimal thickness may easily be determined experimentally for a given package configuration. Note that some embodiments of the present invention suppress the formation of microwave resonances at the point of generation, in contrast to prior attempts to absorb the microwaves further away from the launch site.

In FIG. 2, the electro-absorptive (EA) modulator 16 is mounted to a dielectric submount or substrate 8. The dielectric submount 8 provides electrical isolation between the active microwave component 16 and the housing 6 and may be made of a ceramic such as BeO or aluminum oxide, for example. Also, when used with high-power microwave devices, the dielectric substrate performs the function of a heat spreader. It is then advantageous that the dielectric substrate be made of a material with high thermal conductivity such as beryllium oxide or aluminum nitride. In the variation of FIG. 2, the dielectric substrate 8 is bonded to an electrically resistive semiconductor 10, which is also bonded to a thermoelectric cooler (TEC) 14. Bonding may be done by soldering to metallized surfaces (not shown) on the dielectric substrate 8 and the electrically resistive silicon 10, use of adhesives, and the like.

The electrically resistive semiconductor 10 may be formed from the same material as the microwave absorber 2, described above. Alternatively, a different electrically resistive semiconductor may be used.

Figure 4:
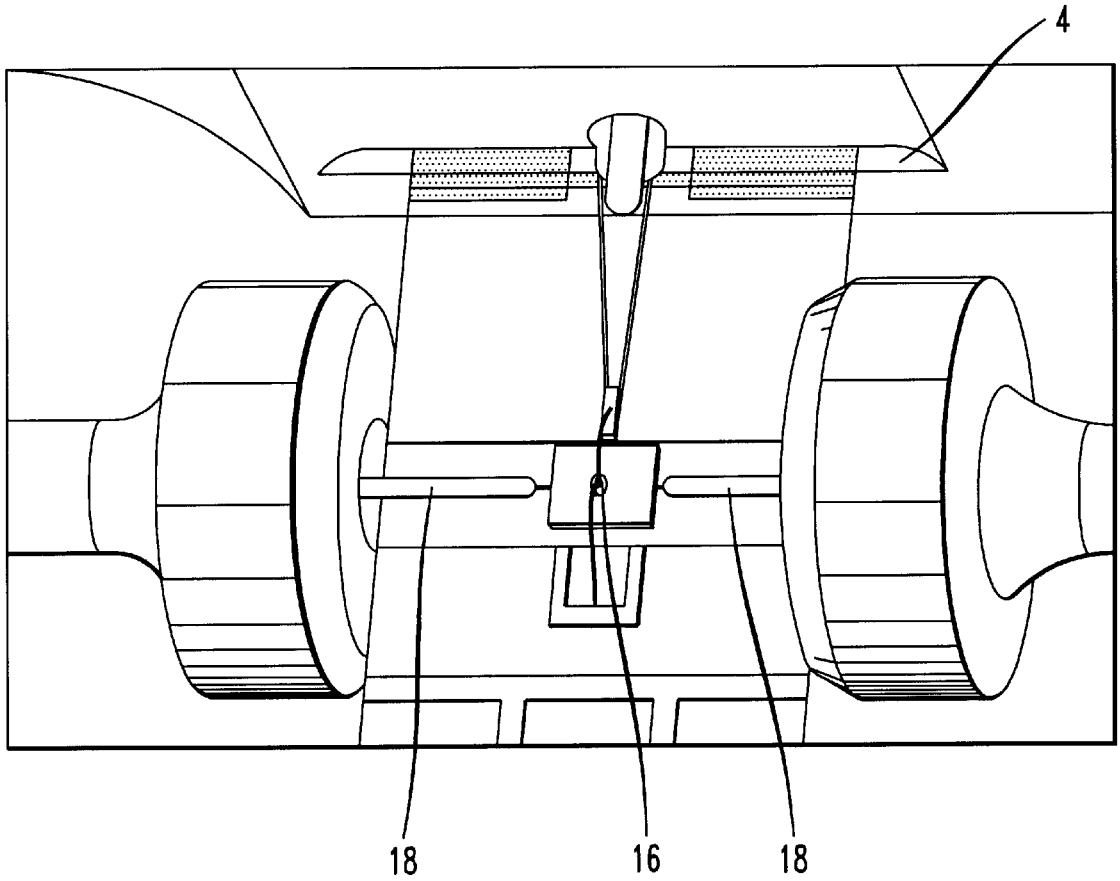
FIG. 4 is a three dimensional view of a microwave component coupled to optical fibers.

FIG. 4 is a three dimensional view of an exemplary microwave device coupled to optical fibers. Optical fibers 18 couple optical energy to microwave component 16. Microwave component 16 is positioned within housing 6 via a structure which is positioned within ledge 4.

While not completely understood, and not wishing to be bound to any theory, electrical modes launched into planar electrical wave-guides may inadvertently couple into stripline modes in the dielectric substrate, the dielectric substrate forming a microwave cavity with the underside of the microwave device and any metal underneath the dielectric. These modes are characterized by strong resonances, which markedly degrade the performance of the device by increasing return loss to greater than −10 dB, which is required for some systems. These modes can be calculated and measured.

The present invention is applicable to 40 GHz electro-absorptive modulators, high-speed receivers and other high-speed optoelectronic devices, for example. Note that while optical microwave packages are described as an embodiment herein, the present invention, and the passive electrically resistive semiconductor, also find applicability in conventional microwave packages.

It has been demonstrated that an optical microwave package containing an electro-absorptive modulator mounted on a beryllium oxide mount, bonded to a thermoelectric cooler, operating at 40 GHZ, exhibits a return loss of −4 to −5 dB. The inventors have discovered that an optical package constructed with a 0.127 mm thick piece of silicon having a resistivity of 15–20 ohms/square interposed between a beryllium oxide mount and a thermoelectric cooler, with a moat filled with silicon having a resistivity of approximately 20 ohms/square, operating at 40 GHZ, exhibits a return loss better than (i.e., less than) −10 dB.

It is emphasized that although the invention has been described with reference to illustrative embodiments, it is not limited to those embodiments. Rather, the appended claims should be construed to include other variants and embodiments of the invention that may be made by those skilled in the art without departing from the true spirit and scope of the present invention.

What is claimed:

1. A microwave package comprising a housing formed of a conductive material, said package comprising:

a moat formed therein to suppress microwave resonant energy;

a dielectric substrate positioned within said housing, wherein a bottom of said substrate is isolated from said housing; and a microwave device mounted on said dielectric substrate, wherein said microwave device comprises one of an electro-absorptive modulator, a high-speed receiver, and a high-speed optoelectric device.

2. A microwave package in accordance with claim 1, wherein said moat is filled with a microwave absorber.

3. A microwave package in accordance with claim 2, wherein said microwave absorber has a resistivity of approximately 20 ohms/sq.

4. A microwave package in accordance with claim 2, wherein said microwave absorber comprises resistive ceramic susceptors, compressed iron powder, or carbon.

5. A microwave package in accordance with claim 2, wherein the microwave absorber comprises a passive electrically resistive semiconductor.

6. A microwave package in accordance with claim 5, wherein the passive electrically resistive semiconductor comprises a material selected from the group consisting of germanium, polycrystalline silicon, single-crystal silicon, gallium arsenide, monolithic doped silicon, and a single crystal semiconductor.

7. A microwave package in accordance with claim 1 wherein an operating frequency is at least 40 GHz.

8. A microwave package in accordance with claim 1, wherein said dielectric substrate comprises beryllium oxide, aluminum nitride, or aluminum oxide.

9. A microwave package in accordance with claim 1, wherein said dielectric substrate is isolated from said conductive material by a microwave absorber.

10. A microwave package in accordance with claim 9, wherein said microwave absorber has a resistivity of approximately 20 ohms/sq.

11. A microwave package in accordance with claim 9, wherein said microwave absorber comprises resistive ceramic susceptors, compressed iron powder, or carbon.

12. A microwave package in accordance with claim 9, wherein the microwave absorber comprises a passive electrically resistive semiconductor.

13. A microwave package in accordance with claim 12, wherein the passive electrically resistive semiconductor comprises a material selected from the group consisting of germanium, polycrystalline silicon, single-crystal silicon, gallium arsenide, monolithic doped silicon, and a single crystal semiconductor.

14. A microwave package in accordance with claim 1 wherein a microwave return loss is less than −10 dB.

15. A microwave package in accordance with claim 1 further comprising a microwave device mounted on said dielectric substrate.

16. A microwave package comprising a housing formed of a conductive material, said package comprising:

a moat formed therein to suppress microwave resonant energy;

a dielectric substrate positioned within said housing, wherein a bottom of said substrate is isolated from said housing;

a microwave device mounted on said dielectric substrate; and a beryllium oxide submount within the housing wherein the microwave device is separated from the submount by the dielectric substrate;

a microwave device mounted on said dielectric substrate, wherein said microwave device comprises one of an electro-absorptive modulator, a high-speed receiver, and a high-speed optoelectric device.

* * * * *